United States Patent [19]

Leonhard et al.

[11] Patent Number: 4,989,408

[45] Date of Patent: Feb. 5, 1991

[54] DEVICE FOR REMOVING SOOT FROM DIESEL EXHAUST

[75] Inventors: Rolf Leonhard, Schwieberdingen; Ulrich Projahn, Ditzingen, both of Fed. Rep. of Germany

[73] Assignee: Robert Bosch GmbH, Stuttgart, Fed. Rep. of Germany

[21] Appl. No.: 415,040

[22] Filed: Sep. 29, 1989

[30] Foreign Application Priority Data

Dec. 7, 1988 [DE] Fed. Rep. of Germany ..... 3841182

[51] Int. Cl.[5] ..... F01N 3/02

[52] U.S. Cl. ..... 60/303; 55/466; 55/DIG. 30; 60/311

[58] Field of Search ..... 60/303, 311; 55/466, 55/DIG. 30

[56] References Cited

U.S. PATENT DOCUMENTS 4,406,119 9/1983 Kamiya ..... 60/303

4,858,431 8/1989 Leonhard ..... 60/303

*Primary Examiner*—Douglas Hart

*Attorney, Agent, or Firm*—Felfe & Lynch

[57] ABSTRACT

A device for removing solid particles, in particular soot particles, from the exhaust gas of internal combustion engines includes a centrifugal separator or cyclone 11 to separate the untreated gas flow 10 into coaxially removed pure gas flow 23 and a particle-enriched carrier gas flow 24 and includes a combustion device 12 for burning the solid particles carried in the carrier gas flow. In order to reduce the manufacturing costs and to obtain a compact, small-volume assembly the combustion housing 16 of the combustion device 12 is integrated in the collecting piece 133 of the cyclone housing 13 such that an annular channel 18 is left between the combustion hosuing 16 and the collecting piece 133 through which a carrier gas flow is passed so as to enter the combustion housing 16 at the end of the latter facing away from the interior of the cyclone housing 13, to pass through a filter 27 heated up above combustion temperature of the solid particles and to finally enter into the vortex core of the cyclone and be removed together with pure gas flow 23. The free end of the collecting piece is closed so as to prevent carrier gas from escaping.

16 Claims, 4 Drawing Sheets

DEVICE FOR REMOVING SOOT FROM DIESEL EXHAUST

BACKGROUND OF THE INVENTION

The invention relates to a device for removing solid particles, in particular soot particles, from the exhaust gas of internal-combustion engines, in particular diesel combustion engines. More particularly, the device is of the type including a centrifugal separator or cyclone which separates tangentially supplied exhaust gas into a mostly particle-free pure gas flow and a particle-enriched carrier gas flow. The cyclone has a cylindrical part, a conical part attached thereto, and a collecting part attached to the end of the conical part. A combustion housing in the cyclone includes a supply chamber which receives the carrier gas, a combustion chamber provided with a filter through which the carrier gas flows while exposed to a flame, and an outlet chamber.

In exhaust gas purification devices of the aforesaid kind an agglomerator in which an electrostatic high frequency field is generated is disposed upstream of the centrifugal separator or cyclone in the exhaust gas flow. Electric charging causes the solid particles to coagulate in the high frequency field so as to form larger agglomerates; due to the relative high weight, it is easy to mechanically separate the latter from the exhaust gas flow. The mechanical separation is carried out in a centrifugal separator or cyclone to which the exhaust gas flow containing the agglomerates is supplied at a relatively high tangential flow rate. A rotational flow is generated in the centrifugal separator by means of which the heavy agglomerates are deposited at the external walls; in spirals they travel to the end, e.g. to the bottom, from where they are supplied to a combustion device, together with a small portion of the exhaust gas, as a so-called particle-enriched carrier gas flow. A major portion of the exhaust gas flow centrally emerges from the centrifugal separator as a core flow, mostly free of particles; as a pure gas flow it is supplied to the exhaust system of the combustion engine. Generally, the carrier gas flow heavily loaded with soot or other solid agglomerates amounts approximately 1% of the pure gas flow.

In exhaust gas purification devices of the aforesaid kind disclosed in U.S. Pat. No. 4,649,703 (DE No. 34 24 1961A), the combustion device is provided with a housing which is separate from the centrifugal separator and in which a combustion chamber is inserted. A connecting pipe leads from the collecting piece of the centrifugal separator to the combustion device where it coaxially extends as an immersion tube from the one front side into the housing to end in the combustion chamber. An electrical heater is installed in the combustion chamber. On the side facing away from the immersion tube the combustion chamber itself is open toward the bottom of the housing and there it is provided with a filter disposed downstream of the heater in the exhaust gas flow. The housing has an outlet for the burn-up gases and the filtered carrier gas flow close to the one front side into which the connecting line to the collecting piece ends. An electrical heating maintains the combustion chamber at a temperature between approximately 500° to 600° C. These temperature is sufficient to heat up the soot particles, which are supplied, to the temperature of combustion. Soot particles which were not burnt in the area of the electrical heater are collected in the filter which is disposed downstream. The filter, too, heated up by the gas flow has a temperature sufficiently high to burn soot particles such that the soot particles collected there subsequently completely glow away. The purified carrier gas flow emerging at the filter outlet then flows—annularly enclosing the combustion chamber and immersion tube in a counter current—to the front end and via the outlet into an exhaust gas line. This flow about the combustion chamber and the immersion tube results in a heat recovery such that the electrical heat supply can be reduced. To further improve energy efficiency the housing is well insulated such that the heat loss is maintained at a relatively low level.

In another known exhaust gas purification device disclosed in U.S. Pat. No. 4,672,808 (DE No. 35 26 074 A1), the combustion device is provided with a combustion chamber and a fuel-operated pilot burner. The carrier gas inlet piece which is configured as an immersion tube and connected to the collecting piece of the centrifugal separator ends freely in the interior of the combustion chamber directly before an overflow opening in a chamber wall separating the pilot burner from the actual combustion chamber. A burning fuel-air-mixture coming from the pilot burner is supplied to the combustion chamber via the overflow opening. The flame encloses the end of the immersion tube and burns down in the combustion chamber together with the solid particles supplied via the immersion tube. The combustion products of the burnt-down solid particles and the remaining residual gases, generally referred to as the gaseous burn-up, are, coaxially to the immersion tube, let off via the outlet opening.

SUMMARY OF THE INVENTION

According to the invention, the combustion housing is incorporated in the collecting part with an annular channel formed between the external wall of the combustion chamber and the internal wall of the collecting part. The supply chamber is located at the end of the collecting part facing away from the conical part, and the outlet chamber faces the conical part and has an outlet opening coaxial with the pure gas opening at the other end of the cylindrical part.

The device in accordance with the invention has the advantage that labor and cost involved in manufacture are reduced by integrating the combustion device into the centrifugal separator; furthermore, the device is very compact such that it can be installed without problems in vehicles and with hardly any additional assembly volume required.

An advantage of the invention is that the exhaust gas flow of the combustion device is directly supplied to the cyclone's vortex core and hence, the subatmospheric pressure present therein and the suction effect thereof are used to maintain the carrier gas flow required for the particle transport even while charging the filter. Installing expensive additional devices such as a Venturi tube in the exhaust gas piece is thus avoided.

Another advantage is that the combustion housing is exposed to the hot carrier gas flow through the annular channel. This counter current principle permits easy heat recovery.

Suitable dimensions of the channel width of the annular channel permit baffling and reducing the carrier gas flow so as to minimize the heating power required for reaching the temperature for combustion of the solid or soot particles.

Adjusting the radial width of the annular channel such that the carrier gas flow is reduced to the minimum amount required for particle transportation ensures a reliable particle transportation while a minimum heating power is involved.

If the collecting piece, in accordance with a further embodiment of the invention, is closed by a flange embracing the burner cap and attached to the end of the collecting piece and if the combustion housing close to the outlet chamber is supported by beads which are stamped out of the wall of the collecting piece the combustion housing can be easily and rapidly mounted and removed again which ensures an easy replacement of the filter in the combustion chamber. While removed the filter can be rinsed which increases its service life. Configuring the beads correspondingly also permits modifying the cross section of the choke of the annular channel. For the particle filtration any suitable material can be selected for the filter. Ceramic monolith, ceramic foam, wire netting, etc. proved good for this purpose.

In an advantageous embodiment of the invention the filter is configured as a hollow cylinder and supported at a radial distance in the combustion chamber such that an annular gap which is closed toward the supply chamber remains between the external wall of the hollow cylinder and the internal wall of the combustion chamber. On the front side facing toward the outlet chamber the hollow cylinder is covered at least in the area of its inside diameter. In such a filter design the particle-loaded carrier gas flow flows through the filter material radially from the inside toward the outside which results in temperature differences favorable to the energy consumption.

In an advantageous embodiment of the invention the combustion housing is disposed transversely to the axis of the cyclone housing and the outlet chamber is configured as a smoke tube having an angle which is led as far as into cone-like part of the cyclone housing. This design is distinguished by an increased heat recovery since the surface of the combustion housing surrounded by the carrier gas flow is greater.

In a further embodiment of the invention the coaxial pure gas removal of the centrifugal separator is configured as an immersion tube axially extending through the entire cyclone housing; the tube encloses the outlet opening of the outlet chamber and is provided with a perforated wall section in the area of the cone-like part of the cyclone housing. In a modified embodiment of the invention the coaxial pure gas removal in the cyclone housing is configured as a axial immersion tube freely ending in the cylinder part; in the end portion of this tube a hollow displacement body is inserted which is provided with air guiding vanes. The displacement body is placed on top of the diminished front end of a cone shaped tube the other front end of which encompasses the outlet opening of the outlet chamber. In both of these basically known embodiments of immersion tubes to recover a part of the rotational energy in the centrifugal separator or cyclone the burn-up gas flow emerging from the outlet gas chamber can, through the immersion tube, be directly supplied to the exhaust pipe of the vehicle.

DETAILED DESCRIPTION OF THE PREFERRED EMBODIMENTS

Figures 1, 2:
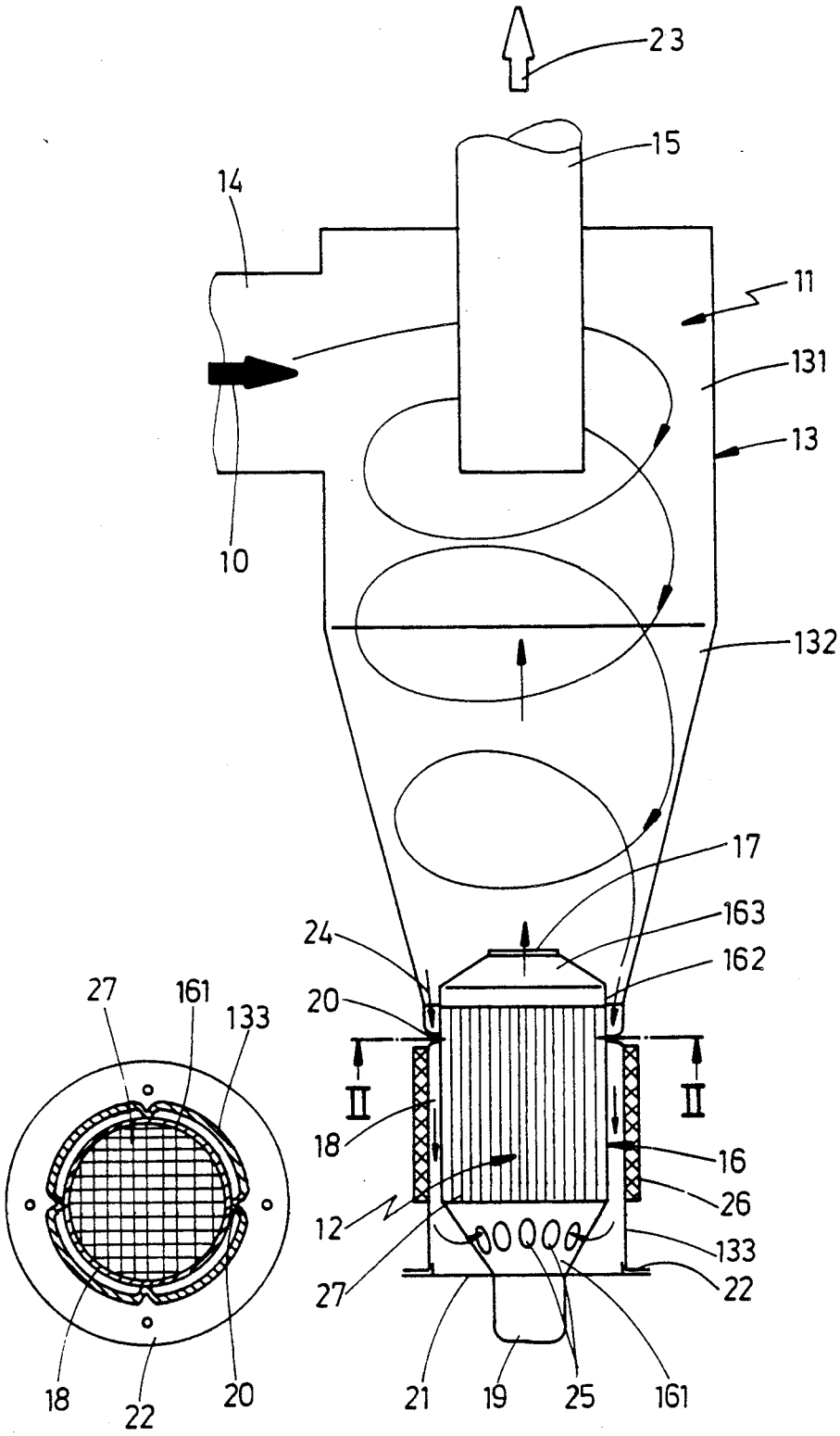
FIG. 1 is a longitudinal cross section of an exhaust gas purification device for a diesel combustion engine.
FIG. 2 is a section taken along line II—II in FIG. 1.

Generally, the exhaust gas emerging from a diesel combustion engine (not represented) is supplied to an agglomerator, also referred to as a soot separator or electrofilter tube having a high frequency field in which solid particles, in particular soot particles, contained in the exhaust gas coagulate to form larger sized agglomerates which can be more readily separated from the gas flow due to their weight. This so-called untreated gas flow (in FIG. 1 symbolized with an arrow 10) loaded with agglomerates is supplied to the exhaust gas purification device. The latter includes a centrifugal separator or cyclone 11 and a combustion device 12. The cyclone housing 13, flatly disposed in mounting position, is subdivided in three housing segments: a cylinder part 131 provided with a tangential exhaust gas supply 14 and a central coaxial pure gas outlet 15, a conical part 132 attached to the end thereof which diminishes toward its end and a collecting piece 133 following the cone. In a combustion housing 16 the combustion device 12 is provided with a combustion chamber 161, a supply chamber 162 disposed in flow direction upstream of the combustion chamber 161 and an outlet chamber 163 disposed in flow direction downstream of the combustion chamber 161. Starting at the combustion chamber 161, there is, at the free end of the conically diminishing supply chamber 162, a burner cap 19 including a fuel-operated burner pilot which generates the combustion flame extending through the supply chamber 162 into the combustion chamber 161. The combustion device 12 is integrated in the cyclone 11 in that the combustion housing 16 is inserted in the collecting piece 133 of the cyclone housing 13 with the supply chamber 162 positioned close to the end of the conical part 132 facing away from the collecting piece 133, and the outlet chamber 163 including the outlet opening 17 coaxial to the pure gas outlet 15 and facing toward the conical part 132. A hollow-cylindrical annular channel 18 remains between the external wall of the combustion housing 16 and the internal wall of the collecting piece 133; this is ensured in that the combustion housing 16 is supported on beads 20 close to the outlet chamber 163 in the area of the combustion chamber 161; the beads are stamped out from the wall of the collecting piece 133. The free end of the collecting piece 133 is covered by a flange 21 encompassing the burner cap 19; the flange 21 is bolted to a collar 22 at the free end of the collecting piece 133. On the one hand, the flange 21 seals the cyclone housing gas-tight and, on the other hand, it functions as a mounting for the combustion housing 16. The combustion housing 16 can be easily removed from the cyclone housing 13 by unscrewing the flange bolts.

The untreated gas flow 10 tangentially entering the cyclone 11 triggers in the cyclone housing a downwardly directed rotational current; this divides the untreated gas flow 10 into a pure gas flow 23 which is removed via a pure gas outlet 15 and a carrier gas flow 24. The pure gas flow 23 is practically free of particles and enters the pure gas outlet 15 via the core of the vortex current. The carrier gas flow 24 is enriched with soot particles or other different particles and flows into the collecting piece 133. Here, it passes through the annular channel 18 while heating up the combustion chamber 161 according to the counter current principle and enters the supply chamber 162 via openings 25 provided in the chamber wall. The openings 25 are disposed in circumferential direction, preferably equally spaced apart. An appropriate height of the beads determines the width of the annular channel such that the carrier gas flow 24 is reduced to the minimum amount required for the particle transport. To reduce the energy consumption the collecting piece 133 can be coated with a heat insulating layer 26 in the area of the annular channel 18.

A filter 27 is disposed in the combustion chamber 161 and fills the latter almost completely. Ceramic monolith, ceramic foam or a wire netting is used as a filter material. The carrier gas flow 24 entering the supply chamber 162 via openings 25 now flows through the filter 27; during this process all solid particles, especially soot particles, are retained if not already burnt in the supply chamber 162. From the outlet chamber which is configured as a cone the purified gas flow enters the core of the vortex current in the cyclone housing 13. The combustion flame heats up the filter material to a temperature which is above the combustion temperature of the solid particles. The solid particles retained in the filter 27 thus burn up completely and together with the purified carrier gas flow the burn-up gases reach the vortex core in the cyclone housing 13. The burn-up of the solid particles maintains free the filter and the risk of blocking is largely reduced. Due to the heating up of the combustion chamber 161 and the filter 27 by the hot carrier gas flow passing through the annular channel 18, the heating power required for the pilot burner to burn up the soot and solid particles is maintained at a relatively low level. In addition, the filter 27 can be rinsed after removing from the combustion housing 13 which increases its overall service life.

Figure 3:
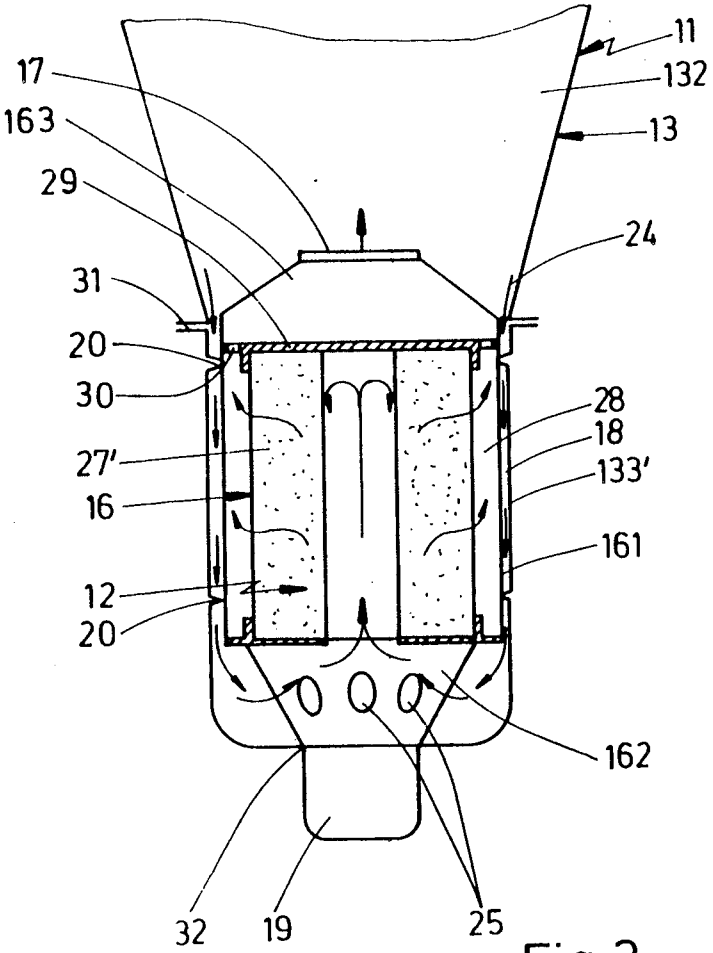
FIG. 3 is a partial longitudinal section of a second embodiment.

FIG. 3 is a fragmentary representation of an embodiment of a further exhaust gas purification device which illustrates a modification of the combustion housing 16 with regard to the filter 27'. The filter 27' is configured as a hollow cylinder and supported in the combustion chamber 161 at a radial distance such that an annular gap 28 remains between the external wall of the filter 27' and the internal wall of the combustion chamber 161; the annular gap 28 is closed toward the supply chamber 162. On the front side facing toward the outlet chamber 163, the filter 27' is covered by a sheet metal 29. To support the filter 27' in the combustion chamber 161, the sheet metal 29 is continued up to the internal wall of the combustion chamber 161 and, in the area of the annular gap 28, provided with a multiple of boreholes 30. As indicated by arrows in FIG. 3, the carrier gas flow 24 is supplied to the filter 27' via the annular channel 18 and the cone-shaped supply chamber 162. Since the internal diameter of the hollow cylinder is closed by the sheet metal 29 the filter material is passed through radially from the inside to the outside, which results in a temperature distribution favorable to the energy consumption. The burn-up gases as well as the purified carrier gas flow are supplied to the core of the vortex current via the boreholes 30 and the apex cone of the outlet chamber 163. In an additional modification the collection piece 133' is not configured as one piece together with the cyclone housing 13 but, by means of an annular flange 31, attached to the conical part 132 which, in turn, is provided for this purpose with a corresponding annular flange 36. The collecting piece 133' is configured as a cup having a central recess 32 at its bottom through which the burner cap 19 of the combustion device 12 extends. In order to remove the combustion device 12, the collecting piece 133' must be detached from the annular flange 36 and the combustion housing 16 must be axially extracted from the collecting piece 133'. Apart from this, the exhaust gas purification device according to FIG. 3 is identical with exhaust gas purification device as described in FIG. 1 such that same components bear the same reference numerals. In both exhaust gas purification devices the combustion housing 16 is coaxially disposed with the conical part 132 and the cylindrical part 131 of the cyclone housing.

Figure 4:
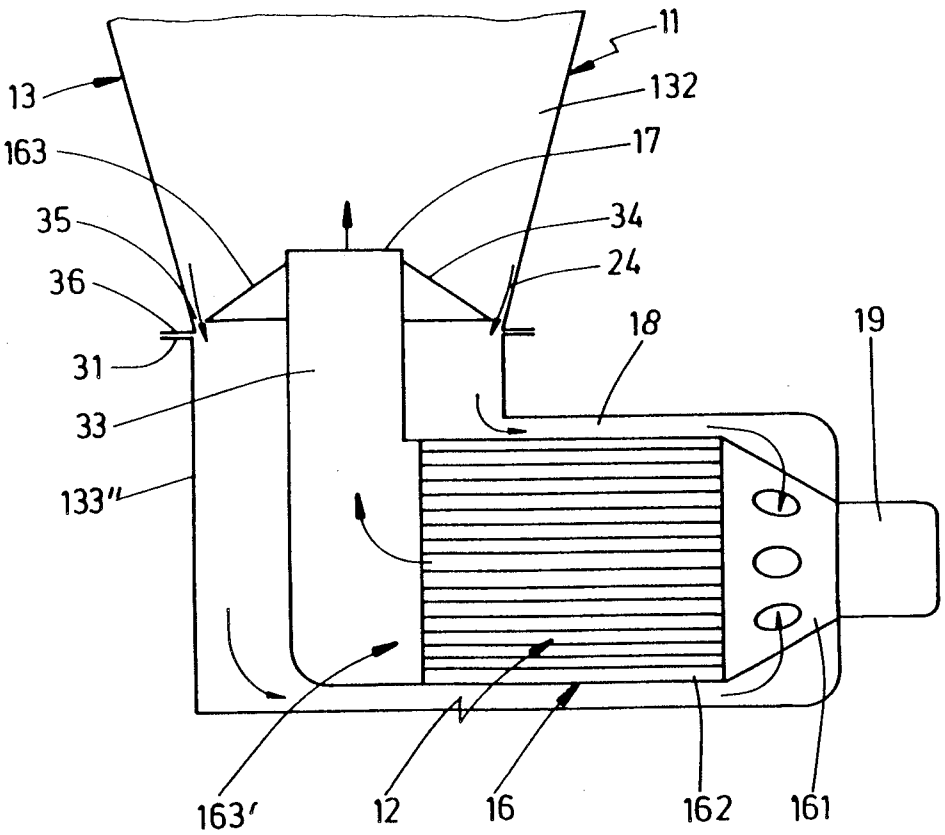
FIG. 4 is a partial longitudinal section of a third embodiment.

The embodiment of FIG. 4, a diagrammatical sketch, illustrates a further exhaust gas purification device wherein the combustion housing 16 is disposed transversely to the axis of the conical part 132 and the cylinder part 131 of the cyclone housing 13. The outlet chamber 163' is configured as a smoke tube 33 having an angle which extends into the conical part 132 of the cyclone housing 13. The outlet opening 17 of the smoke tube 33 is surrounded by a cone-like collar 34 which extends toward the internal wall of the conical part 132; this collar provides an annular gap 35 toward the internal wall of the conical part 132. The radial width of the annular gap is adjusted so as to approximately correspond to the radial width of the annular channel 18. The collecting piece 133'' of the cyclone housing 13 is also configured so as to form an angle and attached via the annular flange 31 to the annular flange 36 at the end of the conical part 132. In this embodiment an increased heat recovery is obtained from the carrier gas flow since the surface of the combustion housing 16 around which the carrier gas flow passes is significantly greater.

Figure 5:
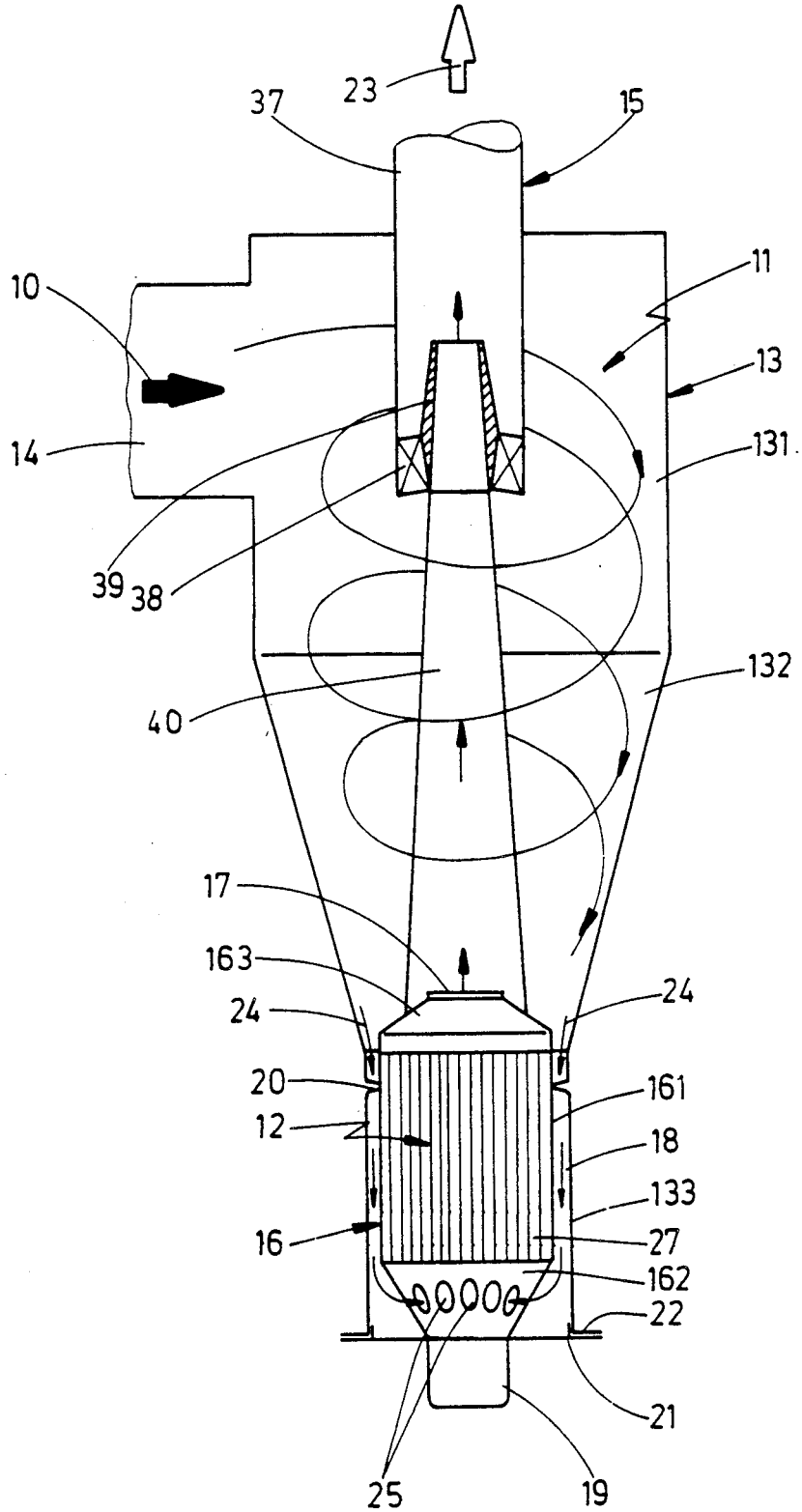
FIG. 5 is a partial longitudinal section of a fourth embodiment.

The embodiment of an exhaust gas purification device of FIG. 5, a sketch in longitudinal cross section, is distinguished from the device as illustrated in FIG. 1 by a different configuration of the immersion tube 37 of the pure gas outlet 15. The configuration includes an immersion tube which freely ends in the cylindrical part 131 of the cyclone housing 13 and in the final portion of which a hollow displacement body 39 is inserted having air guiding vanes 38. The displacement body 39 is placed on the diminished front end of a cone-like tube 40 which rests with its other front end on outlet chamber 163 of the combustion housing 16 where it embraces the outlet opening 17.

Figure 6:
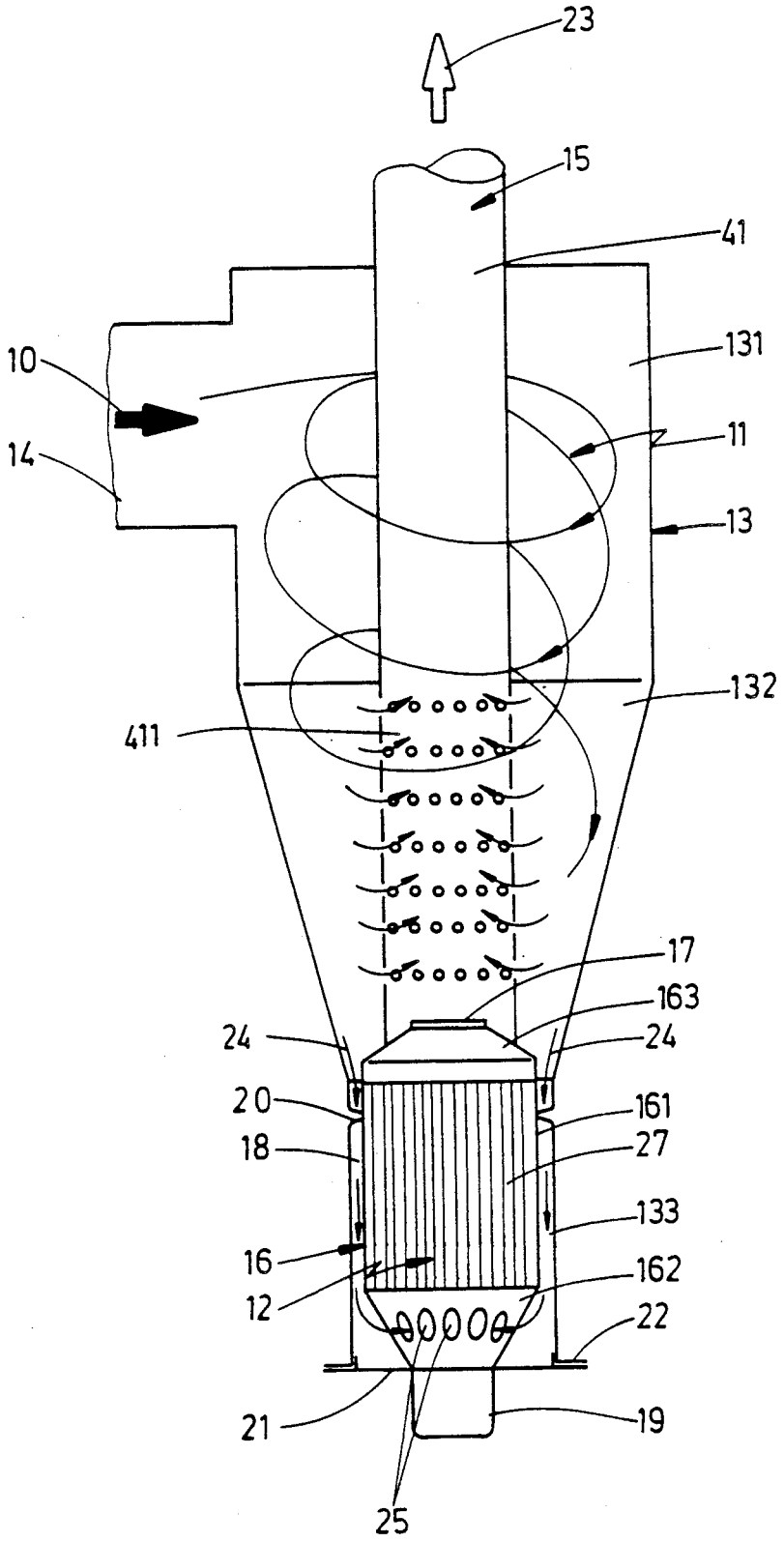
FIG. 6 is a partial longitudinal section of a fifth embodiment.

In the embodiment of an exhaust gas purification device as represented in FIG. 6, the immersion tube 41 of the pure gas outlet 15 extends coaxially through the entire cyclone housing 13 and rests on the front end of outlet chamber 163 of the combustion housing 16 the outlet opening 17 of which it encloses. In the area of the conical part 132 of the cyclone housing 13, the immersion tube 41 is provided with a perforated tube wall section 411 which extends over the entire axial length of the conical part 132. The perforation can be made by means of holes or slots. In the most simple case a perforated or slotted plate is used for the tube wall section 411. Apart from this, the exhaust gas purification device is identical with the exhaust gas purification device as represented and described in FIG. 5 and FIG. 1 such that same components bear the same reference numerals.

We claim:

1. Device for removing solid particles from the exhaust gas of an internal combustion engine, comprising a centrifugal separator which separates the exhaust gas flow into a mostly particle-free pure gas flow and a particle-enriched carrier gas flow, said separator comprising a cylindrical part, a conical part attached thereto which converges toward an end remote therefrom, and a collecting part attached to said end of said conical part, said collecting part having an internal wall and a closed end facing away said conical part, means for tangentially supplying said exhaust gas to said cylindrical part, a pure gas outlet coaxial to said cylindrical part opposite said conical part, a combustion housing incorporated in the separator and comprising a supply chamber located at said closed end of said collecting part and which receives said carrier gas, a combustion chamber located in said collecting part and having an external wall which forms an annular channel with said internal wall and provided with a filter through which said carrier gas flows while exposed to a combustion flame, and an outlet chamber having an outlet opening facing said conical part and coaxial to said pure gas outlet.

2. Device in accordance with claim 1, wherein the radial width of the annular channel 18 is dimensioned such that the carrier gas flow is reduced to the minimum amount required for the particle transport.

3. Device in accordance with claim 1, wherein a burner cap 19 to hold a burner is attached to the end of the supply chamber 162 facing away from the combustion chamber 161 and the chamber wall of the supply chamber 162 is provided with inlet openings for the carrier gas flow.

4. Device in accordance with claim 3, wherein a flange 21 enclosing the burner cap 19 which is attached to the end of collecting piece closes the latter.

5. Device in accordance with claim 4, wherein the combustion chamber 161 is supported by beads 20 which are stamped out of the wall of the collecting piece 133.

6. Device in accordance with claim 1 wherein the supply chamber is configured like a cone with the diameter increasing toward the combustion chamber.

7. Device in accordance with claim 1 wherein the outlet chamber is configured as an apex cone with a diameter increasing toward the combustion chamber.

8. Device in accordance with claim 1 wherein the collecting piece 133 is surrounded by a heat insulating layer at least in the area of the annular channel.

9. Device in accordance with claim 1 wherein the filter is configured as a hollow cylinder and supported in the combustion chamber in a radial distance from the combustion chamber wall such that an annular gap is left between the external wall of the hollow cylinder and the internal wall of the combustion chamber which is closed toward the supply chamber and that the hollow cylinder is covered on its front side facing toward the outlet chamber 163 at least in that area of its clear opening.

10. Device in accordance with claim 1 wherein the combustion housing is disposed coaxially with conical part and cylindrical part 131 of the cyclone housing.

11. Device in accordance with claim 1 wherein the combustion housing 16 is disposed transversely to the axis of the cyclone housing 13 and the outlet chamber 163' is configured as a smoke tube 33 forming an angle which extends into the conical part 132 of the cyclone housing 13 and that the outlet opening 17 of the outlet chamber 163 is surrounded by a collar 34 which is cone-like and downwardly extending to the collecting piece 133" and this collar leaves an annular gap 35 toward the internal wall of the conical part 132 or the collecting piece 133", the width of which, corresponds to the annular channel 18.

12. Device in accordance with claim 1 wherein the coaxial pure gas outlet is configured as an immersion tube axially extending through the conical part and the cylindrical part of the separator and which encloses the outlet opening of the outlet chamber and is provided with a perforated tube wall section in the area of the conical part of the cyclone housing.

13. Device in accordance with claim 12 wherein the perforated tube wall section extends over the entire axial length of the conical part of the cyclone housing up to the outlet opening of the outlet chamber 163 of the combustion housing.

14. Device in accordance with claim 1 wherein the coaxial flue gas outlet is configured as an axial immersion tube freely ending in the cylindrical part of the cyclone housing in the end section of which a hollow displacement body having air guiding vanes is inserted and that the displacement body is placed on the diminishing front end of a conical tube the other front end of which encloses the outlet opening of the outlet chamber in the combustion chamber.

15. Device in accordance with claim 3 wherein the inlet openings for the carrier gas flow are equidistantly distributed about the circumference of the supply chamber.

16. Device in accordance with claim 5 wherein the beads which support the combustion chamber are stamped out of the wall of the collecting piece close to the outlet chamber.

* * * * *